US005415117A

United States Patent [19]

Eisenkolb

[11] Patent Number: 5,415,117

[45] Date of Patent: May 16, 1995

[54] DEVICE FOR AUTOMATICALLY FEEDING CURTAIN HOOKS TO A SEWING MACHINE

[75] Inventor: Gustaaf J. Eisenkolb, Eindhoven, Netherlands

[73] Assignee: Eisenkolb Confectiemachines B.V., Bladel, Netherlands

[21] Appl. No.: 144,533

[22] Filed: Nov. 2, 1993

[30] Foreign Application Priority Data

Nov. 9, 1992 [NL] Netherlands ..... 9201957

[51] Int. Cl.[6] ..... D05B 3/22; B65H 3/08

[52] U.S. Cl. ..... 112/113

[58] Field of Search ..... 112/113, 147, 121.15, 112/121.12, 265.1, 141

[56] References Cited

U.S. PATENT DOCUMENTS

| | | | |
|---|---|---|---|
| 3,156,206 | 11/1964 | Hall et al. | 112/113 X |
| 4,690,077 | 9/1987 | Nirenberg | 112/113 |
| 4,766,826 | 8/1988 | Block | 112/113 X |
| 4,951,586 | 8/1990 | Becherini | 112/147 |
| 4,986,524 | 1/1991 | Meintzer et al. | 112/113 X |
| 5,189,967 | 3/1993 | Schips et al. | 112/113 |

FOREIGN PATENT DOCUMENTS

| | | |
|---|---|---|
| 0290104 | 11/1988 | European Pat. Off. . |
| 2302765 | 7/1974 | Netherlands . |
| 7507991 | 7/1975 | Netherlands . |

OTHER PUBLICATIONS

Brother (Factory Creation), PFA-2000/Microflex, Curtain Hook Feeder.

Curtain Hook (Model), Curtain Hook with Hook and Elongated Strip (of the Invention), Oct. 25, 1994.

*Primary Examiner*—Clifford D. Crowder
*Assistant Examiner*—Ismael Izaguirre
*Attorney, Agent, or Firm*—Young & Thompson

[57] ABSTRACT

For feeding curtain hooks, each consisting of a strip (1) and the hook (5) connected thereto, to a sewing machine which can sew the strip of an infed curtain hook onto a curtain pleat, use is made of a device comprising a storage holder (12) for the curtain hooks, and a device (9) for moving one curtain hook at a time from the storage holder (12) to a desired position for sewing on the strip of that curtain hook. According to the invention, the device (9) move the curtain hooks only in one straight line, the storage holder (12) is in the form of a vertical tube in which the curtain hooks can be stored stacked on top of one another, the bottom end of the storage holder (12) lies in or just above the straight movement path of the moving part (25) of the device (9), so that the moving part (25) can pick up the bottom hook in the storage holder (12), and the moving part (25) of the device (9) can return to the initial position during sewing on of the strip of the curtain hook held in position by the pressure foot of the sewing machine.

7 Claims, 5 Drawing Sheets

DEVICE FOR AUTOMATICALLY FEEDING CURTAIN HOOKS TO A SEWING MACHINE

FIELD OF THE INVENTION

The invention relates to a device for automatically feeding curtain hooks, each consisting of a strip and a hook connected thereto, to a sewing machine which can sew the strip of an infed curtain hook onto a curtain pleat, comprising a storage holder for the curtain hooks and movement means for moving one curtain hook at a time from the storage holder to a desired position for sewing on the strip of that curtain hook.

THE PRIOR ART

Such a device is known from EP-A-0290104.

The movement means of this known device comprise a gripping element with two claws which are movable relative to each other, and pneumatic cylinders to permit movement of the gripping element in two directions at right angles to each other. The gripping element is first moved from an initial position to the storage holder, for the purpose of picking up a curtain hook, and is then moved back to that initial position. The gripping element with curtain hook clamped therein is then moved to a position above the curtain, and the gripping element is subsequently moved to a position where the strip of the curtain hook clamped by the gripping element is lying below the pressure foot of a sewing machine. Finally, the gripping element is moved back to an initial position. As a result of the complicated movement of the gripping element, this known machine is complex and expensive, and the device works relatively slowly.

OBJECT OF THE INVENTION

The object of the invention is to overcome this drawback and to provide a device of the type described in the preamble, by means of which curtain hooks can be sewn to pleated curtains at great speed in an accurate position, and in the case of which the curtain hooks are moved by the movement means in only one direction, without the curtain hooks having to be clamped by said movement means.

SUMMARY OF THE INVENTION

According to the invention, the device mentioned in the preamble is characterized:

in that the movement means can move the curtain hooks only in one straight line;

in that the storage holder is in the form of a vertical tube in which the curtain hooks can be stored stacked on top of one another;

in that the bottom end of the storage holder lies in or just above the straight movement path of the moving part of the movement means, so that said moving part can pick up the bottom hook in the storage holder; and in that the moving part of the movement means can return to the initial position during sewing on of the strip of the curtain hook held in position by the pressure foot of a sewing machine.

With the device according to the invention, a curtain hook can be taken directly from the storage holder in one straight movement to the throat plate of the sewing machine, where the lowered pressure foot clamps the curtain hook, so that the movement means can return immediately afterwards in order to move the next curtain hook.

In order to be able to position a curtain pleat correctly for sewing to the strip of a curtain hook, it is preferable to provide the device with a stop element which can be moved up and down, and against which a curtain pleat can be pushed in a desired position below the sewing machine, means being present for moving the stop element downwards as soon as a curtain hook is moved into a desired position. The fact that the stop element can be moved up and down means that it need not be in the way during the sewing on of the curtain hooks.

If the hook of each curtain hook is connected to the strip, it is preferable to provide the device with means for setting the hook of a curtain hook in a desired height position relative to the strip. These means can preferably consist of a cam which can be tilted against a certain moment, and which can engage in an opening in a strip of a curtain hook in order to retain said strip temporarily, a pushing element which can move the hook relative to the temporarily retained strip, and a stop which is fixed to the pushing element and can strike against an adjustable pin.

The curtain hook can be prevented from tilting away or sliding away if the moving part of the movement means for moving the curtain hooks is provided with two fingers which can engage around a strip of a curtain hook, and with a cam which is fixed on the moving part and can strike against a switch for operating the movement means of said stop element.

The storage means preferably consist of a tubular part for the accommodation of the hook part of the curtain hooks, and a U-shaped part for the accommodation of the strip of the curtain hooks, and the strips project from the U-shaped part and can be of any desired length, while an opening to allow through the connecting piece between hook and strip is provided in the common leg of the tubular part and the U-shaped part.

The storage holder is preferably detachably fixed to the baseplate of the device.

BRIEF DESCRIPTION OF THE DRAWINGS

The invention will now be explained in greater detail with reference to the figures.

DETAILED DESCRIPTION OF THE INVENTION

The device shown is intended for conveying curtain hooks automatically to a desired position below a sewing machine, in which position a curtain pleat is pushed over an infed curtain hook, and said curtain pleat is sewn to the curtain hook.

Figure 4:
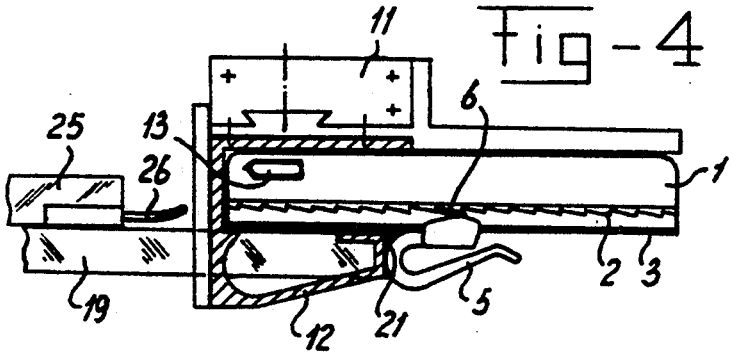
FIG. 4 shows a horizontal section comparable to FIG. 3, but in this case in the position in which the hook is positioned.
Figure 5:
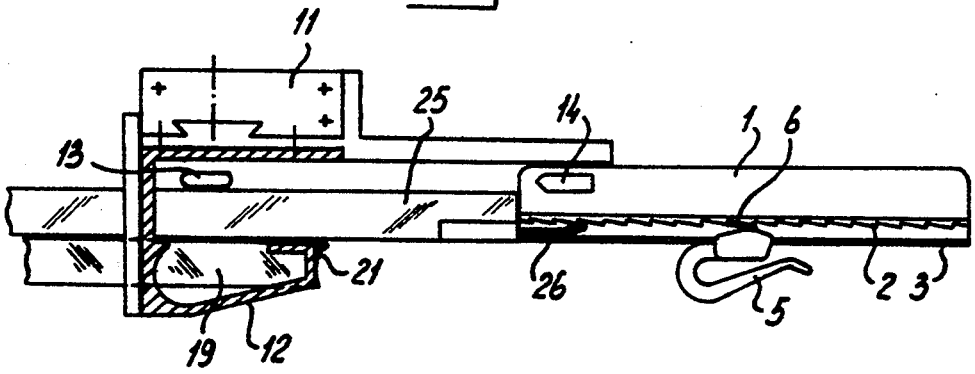
FIG. 5 shows a section which is comparable to FIG. 3, in which a curtain hook is moved to the desired position below a sewing machine.
Figure 6:
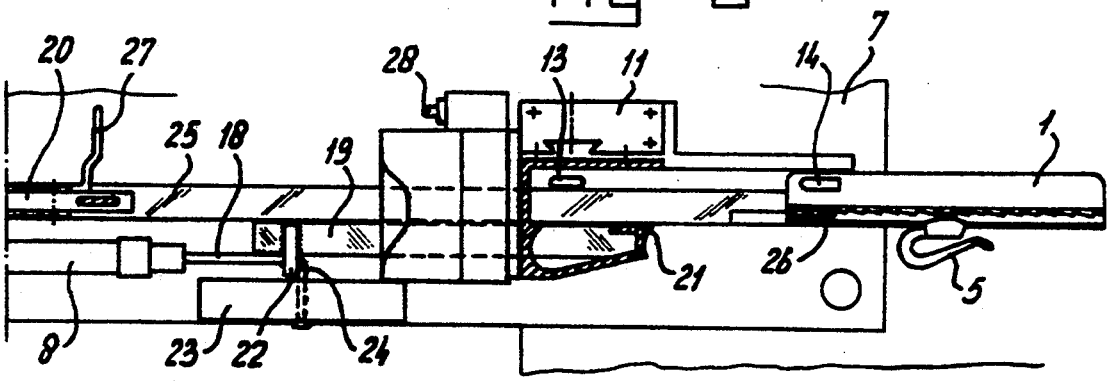
FIG. 6 shows a detail in horizontal section by means of which the positioning of the hook relative to the curtain hanging strip and the movement of the entire curtain hook can be made clear.

Each curtain hook consists of an elongated plastic strip 1, having a serrated profile 2 on two sides and an end flange 3 along which a slide 4 with hook 5 can be slid. Two barbed pins 6 projecting from the slide 4 can engage in the serrated profiles in such a way that the slide 4 with hook can be slid only in the direction of the arrow in FIG. 4, and not in the opposite direction.

Figure 1:
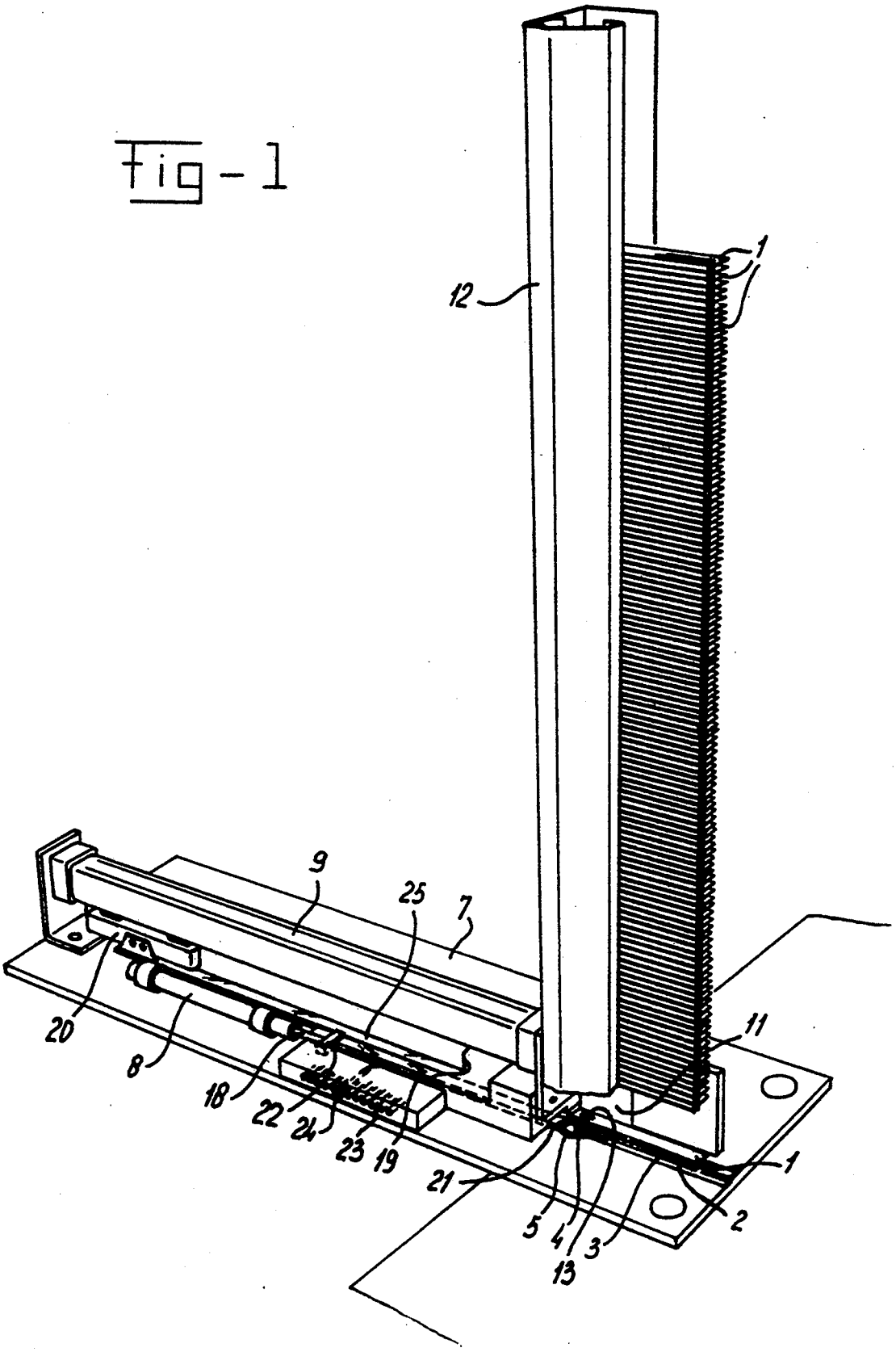
FIG. 1 shows a perspective view of the device.
Figure 2:
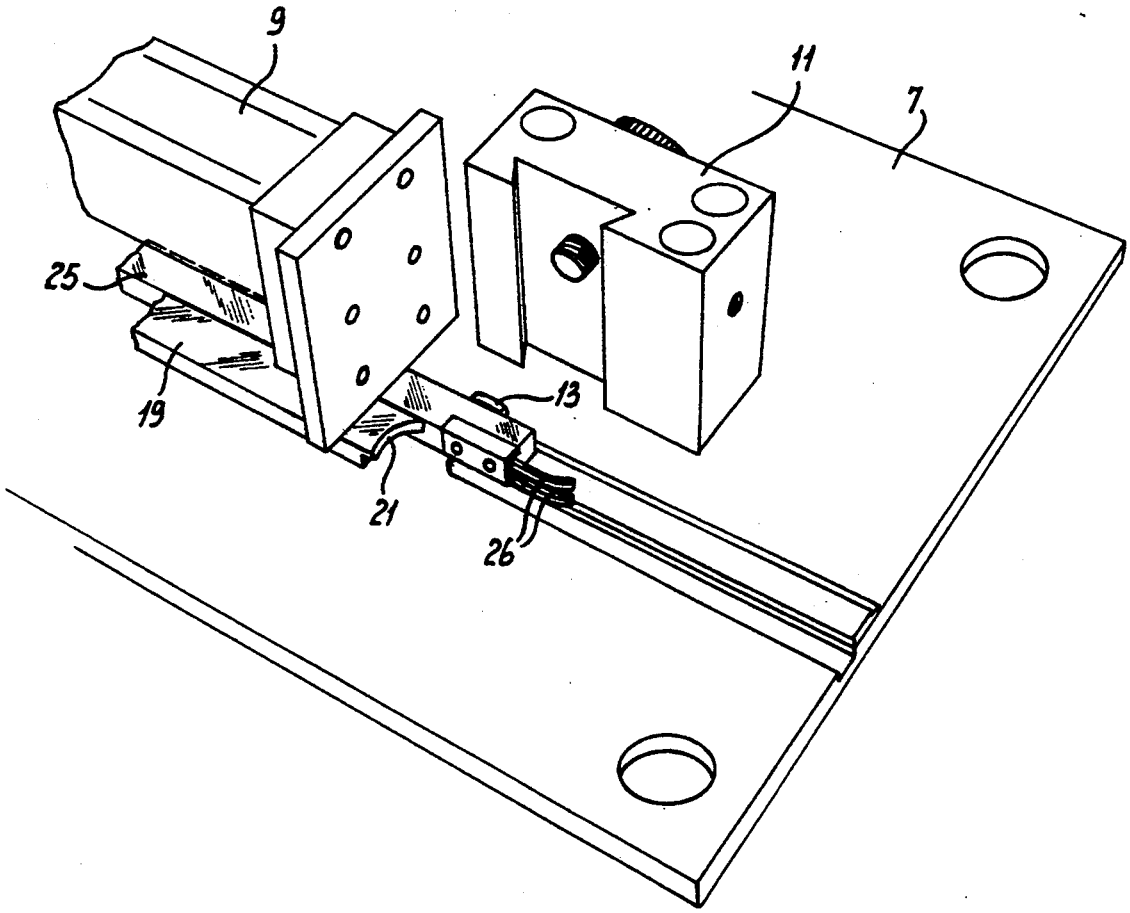
FIG. 2 shows a perspective view on a larger scale of a part of the device shown in FIG. 1.
Figure 3:
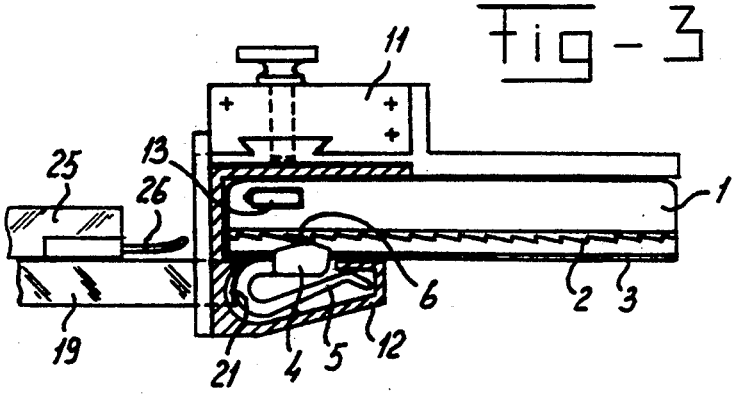
FIG. 3 shows a horizontal section through the storage holder in a neutral position of the hook-positioning means.

The feed device comprises a baseplate 7, pneumatic cylinders 8 and 9 fitted thereon for adjustment of the hook 5 relative to the strip 1 and for movement of the curtain hook to a position below a sewing machine respectively, and a profiled block 11 into which a storage holder 12 for the curtain hooks can be pushed. FIG. 1 shows how the curtain hooks lie stacked on top of one another in the holder 12. The bottom curtain hook of the stock lies on the baseplate 7, while a cam 13 on the baseplate which can tilt against a certain force engages in an opening 14 of the strip 1 of the hook and temporarily holds the curtain hook in place.

The pneumatic cylinder 8 has a piston rod 18 which has a strip 19 with rounded front end 21 welded to it at one side and a cam 22 welded to it at the other side. Next to the movement path of the cam 22 is a box 23 which is fixed on the plate 7 and has adjacent openings into which a pin 24 can be inserted. When the piston rod 18 is sliding out the cam 22 can come into contact with the pin 24 and thus limit the length of slides. As soon as the piston rod 18 slides out of the cylinder 8, the bent front end 21 of the strip 19 picks up the hook 5 and slides said hook forwards until the cam 22 comes into contact with the pin 24. The hook 5 has then reached a position relative to the strip 1 which is determined by the choice of hole into which the pin 24 is inserted in the block 23.

Figure 7:
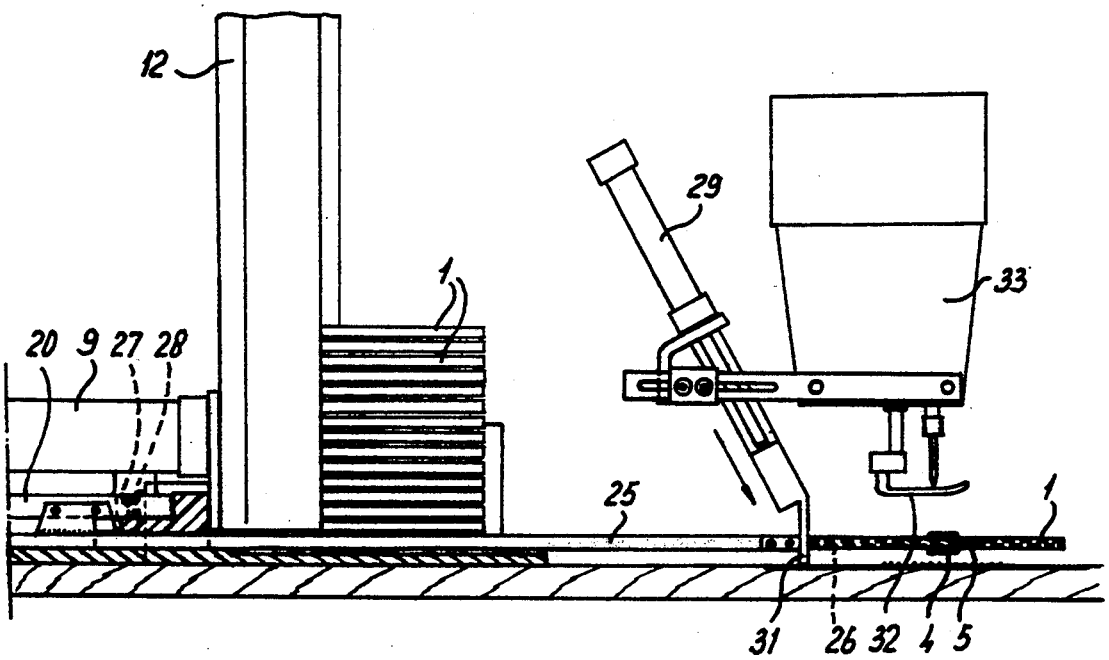
FIG. 7 shows a view of a part of the automatic feed device and of the sewing machine.

The pneumatic cylinder 9 is then operated, as a result of which a rod 25, which is connected by way of a magnet 20 to the piston of said cylinder, is slid out, which rod 25 is provided at its front end with two fingers 26 which come to rest around the strip 1 of a curtain hook. The curtain hook is pushed forward until a cam 27 welded on the piston rod 25 strikes against a switch 28, which operates a pneumatic cylinder 29 (FIG. 7), as a result of which a stop element 31 connected to the piston rod of said cylinder is moved into the downward position shown in FIG. 7. The end of the element 31 is fork-shaped and falls over the end of the rod 25.

Figure 8:
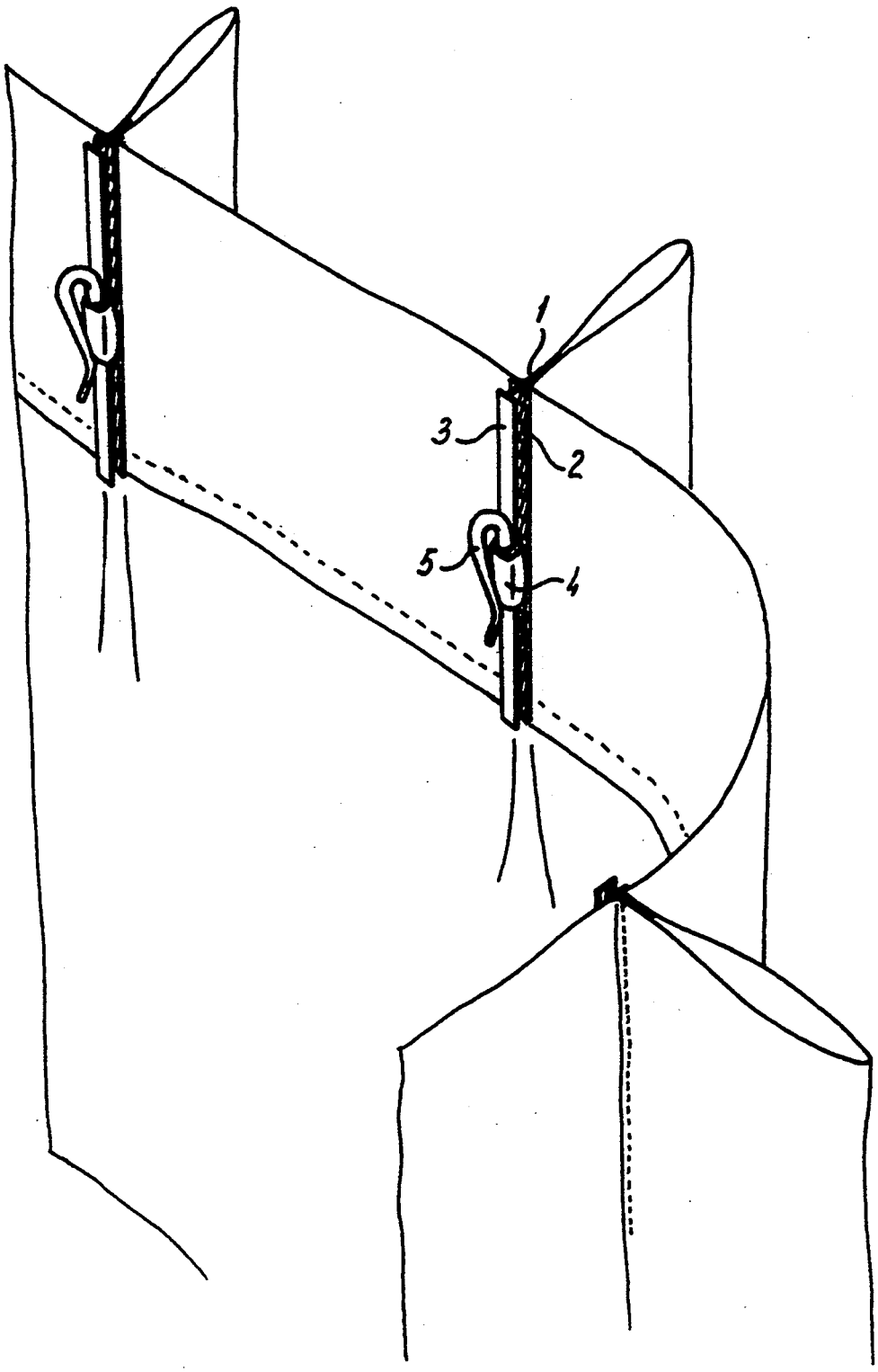
FIG. 8 shows a perspective view of the folded top edge of a curtain with curtain hooks fitted therein.

A curtain pleat is moved in such a way by an operative that the flat strip part of the infed curtain hook 1 to 6 falls into the pleat. The stop element 31 serves as a positioning element for the curtain pleat. As soon as said pleat has taken up the desired position relative to the curtain hook, the operative operates the pressure foot of the sewing machine in order to fix material and curtain hook, and a signal is given so that the rod 25 returns to its initial position, the stop element 31 is moved up by the cylinder 29, and the sewing machine 32 sews the curtain hook to the curtain pleat. The result of this operation can be seen in FIG. 8.

The device described makes it possible to set the height position of the hook 5 relative to the top edge of the curtain fully automatically and to sew the curtain hook to the curtain at high speed and with constant positioning accuracy. The cost of the operation will be relatively low.

I claim:

1. In combination with a sewing machine having a presser foot, a device for automatically feeding curtain hooks to the sewing machine to be sewed to curtains, the hooks each consisting of a straight elongated strip and a hook connected to the strip, said device comprising a storage holder for storing the curtain hooks in a vertical stack consisting of a plurality of superposed curtain hooks, and a reciprocating pusher that engages only an end of said strip of the lowermost hook in the stack while said lowermost hook is still in the stack and pushes said lowermost hook in a direction lengthwise of said strip of said lowermost hook to slide said lowermost hook with rectilinear movement lengthwise of said strip along a stationary support surface and to position said lowermost hook below said presser foot.

2. The combination of claim 1, further comprising an upwardly and downwardly movable stop element adjacent said presser foot to serve as a guide for an edge of a curtain onto which a said hook is to be sewed, and means responsive to movement of said pusher in a direction to place a hook below said presser foot to move said stop element downwardly.

3. In a device for automatically feeding curtain hooks each comprising a strip (1) and a hook (5) connected to the strip for movement along the strip thereby to position the hook at a selected elevation when the curtain hook is sewed onto a curtain pleat, the device comprising a storage holder for storing curtain hooks, and means for moving one curtain hook at a time from the storage holder to a desired position for sewing the strip of that curtain hook to a curtain pleat; the improvement comprising means for setting the hook along the strip at a desired position relative to the strip, and means for thereafter feeding the curtain hook with the hook thus positioned on the strip, to a position for sewing the curtain hook onto a curtain pleat.

4. Structure as claimed in claim 3, wherein the means for setting the hook comprises a cam which engages in an opening in the strip in order to retain the strip temporarily and which retracts from the opening when a predetermined force is applied to the strip, a pushing element that moves the hook relative to the temporarily retained strip, and the stop which is fixed to the pushing element and that strikes against an adjustable pin to determine the distance by which the hook is moved along and relative to the strip.

5. In a device for automatically feeding curtain hooks each comprising a strip (1) and a hook (5) connected to the strip for movement along the strip thereby to position the hook at a selected elevation when the curtain hook is sewed onto a curtain pleat, the device comprising a storage holder for storing curtain hooks, and means for moving one curtain hook at a time from the storage holder to a desired position for sewing the strip of that curtain hook to a curtain pleat; the improvement wherein said moving means comprises a pusher having two fingers which engage around said strip and between which said strip is carried to said desired position.

6. In a device for automatically feeding curtain hooks each comprising a strip (1) and a hook (5) connected to the strip for movement along the strip thereby to position the hook at a selected elevation when the curtain hook is sewed onto a curtain pleat, the device comprising a storage holder for storing curtain hooks, and means for moving one curtain hook at a time from the storage holder to a desired position for sewing the strip of that curtain hook to a curtain pleat; the improvement wherein said storage holder comprises a tubular part for accommodating the hook of the curtain hooks and a U-shaped part for accommodating the strip of the curtain hooks, the U-shaped part being open such that the strips project from the U-shaped part and hence can be of any desired length, said tubular part and said U-shaped part having an opening therebetween to receive a connecting piece between said hook and strip of each curtain hook.

7. Structure according to claim 6, wherein the storage holder is detachably fixed to a base plate of the device.

* * * * *